US006295899B1

(12) United States Patent
Lee

(10) Patent No.: US 6,295,899 B1
(45) Date of Patent: Oct. 2, 2001

(54) WRENCH FOR DRIVING VARIOUS FASTENERS

(76) Inventor: Wen Kai Lee, 7F, No. 46, Pin Ho 10 Street, Chang Hua (TW), 500

( * ) Notice: Subject to any disclaimer, the term of this patent is extended or adjusted under 35 U.S.C. 154(b) by 0 days.

(21) Appl. No.: 09/614,446

(22) Filed: Jul. 12, 2000

(51) Int. Cl.[7] ..... B25B 13/12
(52) U.S. Cl. ..... 81/179
(58) Field of Search ..... 81/179, 60

(56) References Cited

U.S. PATENT DOCUMENTS 810,304 * 1/1906 Remion ..... 81/179
3,906,822 * 9/1975 Hertelendy et al. ..... 81/179 X
4,440,047 4/1984 Robbins .

* cited by examiner

*Primary Examiner*—James Smith

(57) ABSTRACT

A wrench includes a drive head having an opening and a number of notches each having an inclined surface. The inclined surfaces each has one end located closer to the center of the head and the other end distal to the center of the head. A barrel is rotatably received in the head and has a bore for receiving a fastener and has a number of channels for receiving a drive insert each. The sliding engagement of the drive inserts with the inclined surfaces of the head may adjust the drive inserts into and out of the bore of the barrel to engage with fasteners of different sizes.

7 Claims, 3 Drawing Sheets

WRENCH FOR DRIVING VARIOUS FASTENERS

BACKGROUND OF THE INVENTION

1. Field of the Invention

The present invention relates to a wrench, and more particularly to a wrench having an adjustable mechanism for engaging with and for driving the fasteners of different sizes.

2. Description of the Prior Art

U.S. Pat. No. 4,440,047 to Robbins discloses a typical wrench having a number of longitudinal or inclined grooves formed in the driving head thereof for slidably receiving a number of drive inserts respectively. A number of springs are required to be engaged into the grooves and engaged with the drive inserts for biasing the drive inserts to engage with the fasteners to be driven. The drive inserts each is required to be engaged with and biased by a spring member such that a complicated structure is thus formed and may not be easily assembled.

The present invention has arisen to mitigate and/or obviate the afore-described disadvantages of the conventional wrenches.

SUMMARY OF THE INVENTION

The primary objective of the present invention is to provide a wrench including a simplified adjustable mechanism for engaging with and for driving the fasteners of different sizes.

In accordance with one aspect of the invention, there is provided a wrench comprising a drive head including an opening for defining an inner peripheral portion and for forming a center, the head including a plurality of notches formed in the inner peripheral portion and each defined by an inclined surface, the inclined surfaces each including a first end located closer to the center of the opening of the head and a second end located distal to the center of the opening of the head, a barrel rotatably received in the opening of the head and having a bore for receiving a fastener to be driven by the drive head and having a plurality of channels communicating with the bore of the barrel, and a plurality of drive inserts slidably received in the channels of the barrel and each having a first end extendible inward of the bore of the barrel for engaging with the fastener, and each having a second end slidably engaged with the inclined surfaces of the head for determining an engagement of the first ends of the drive inserts into the bore of the barrel.

The barrel includes a first end and a second end. A securing device includes a peripheral stop extended radially outward from the first end of the barrel, and includes a ring secured to the second end of the barrel, for engaging with the head and for retaining the barrel within the opening of the head. The ring includes a hand grip extended outward therefrom for rotating the ring and the barrel relative to the head.

A spring biasing device or a magnetic forcing device may further be provided for biasing or forcing the drive inserts to engage with the first ends or the second ends of the inclined surfaces of the head.

The spring biasing device includes a spring engaged between the head and the ring for biasing the ring and the barrel to force the drive inserts to engage with the first ends of the inclined surfaces of the head. The head includes a groove formed therein for receiving the spring, the ring includes an ear extended therefrom and engaged into the groove of the head and engaged with the spring.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
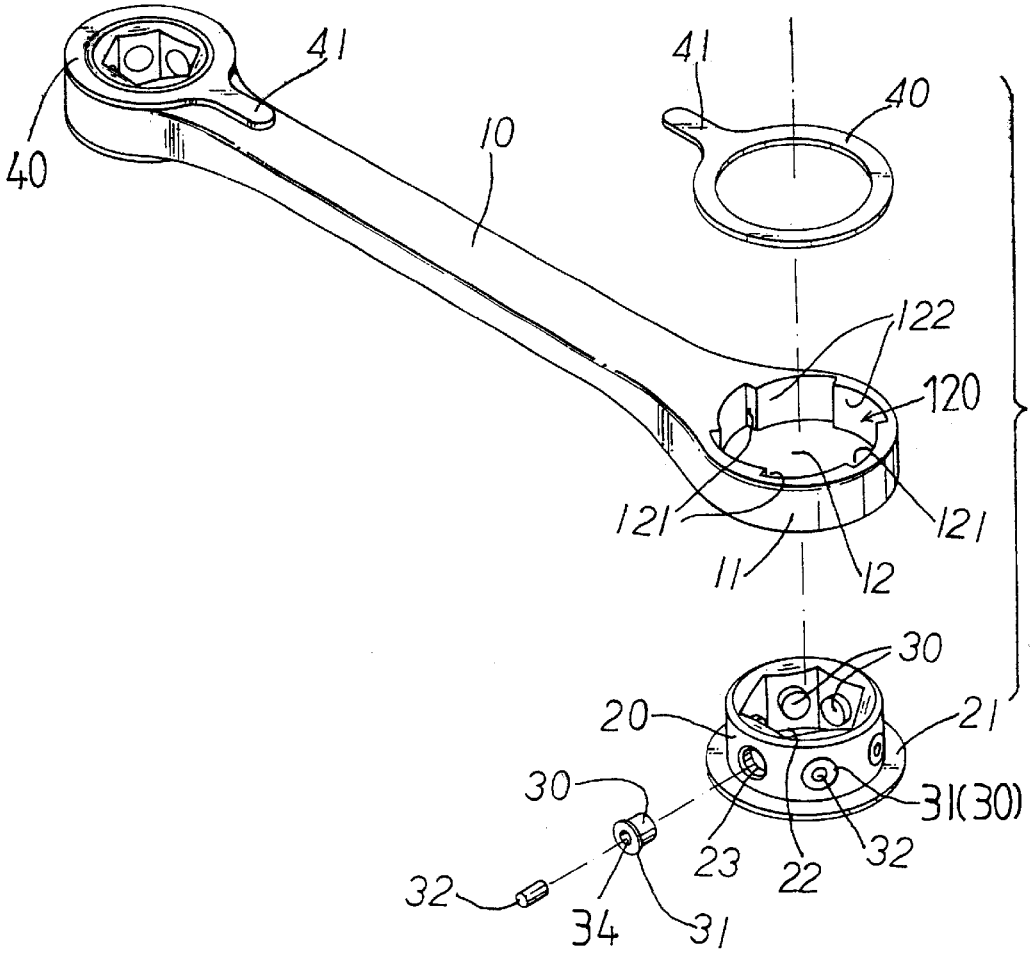
FIG. 1 is a partial exploded view of a wrench in accordance with the present invention.
Figure 2:
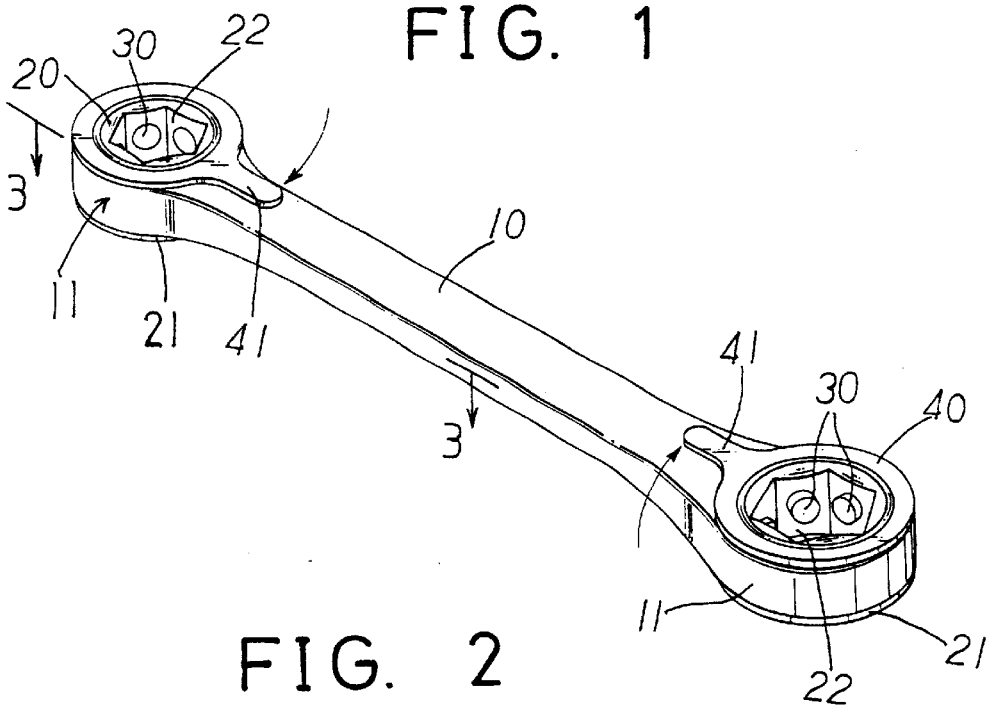
FIG. 2 is a perspective view of the wrench.
Figure 3:
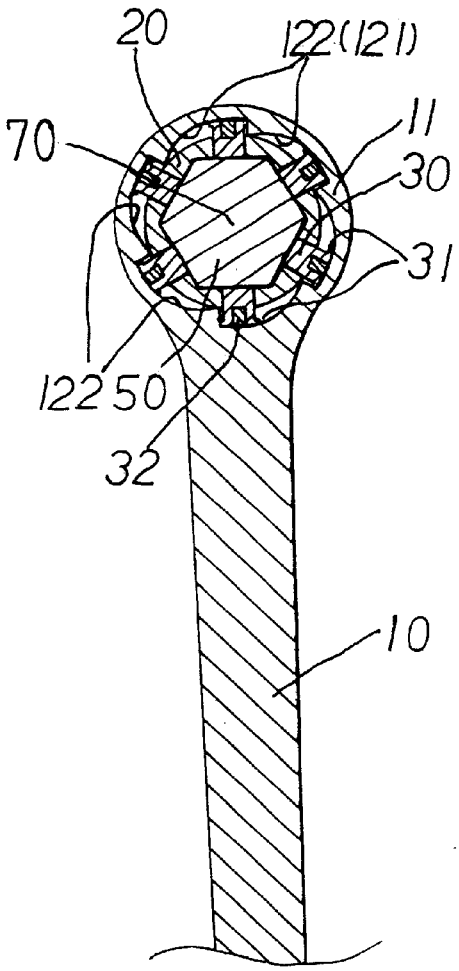
FIG. 3 is a partial cross sectional view taken along lines 3—3 of FIG. 2.

Referring to the drawings, and initially to FIGS. 1–3, a wrench in accordance with the present invention comprises a handle 10 including a drive head 11 formed on one end thereof or formed on each of the two ends thereof. The head 11 includes an opening 12 formed therein for forming or defining an inner peripheral portion 120 therein, and includes a number of notches 121 formed in the inner peripheral portion 120 of the head 11 and communicating with the opening 12 of the head 11 and defined by a curved and inclined or helical surface 122.

A barrel 20 is rotatably received in the opening 12 of each of the heads 11 and includes one end or the lower portion thereof having a peripheral stop 21 extended radially outward therefrom for engaging with the head 11 and for retaining the barrel 20 within the opening 12 of the head 11. A ring 40 is secured on the other end or the upper portion of the barrel 20 with such as the force-fitted engagement or with a welding process, such that the ring 40 may be secured to the barrel 20 and may be rotated in concert with the barrel 20. The ring 40 includes a hand grip 41 extended radially outward therefrom for rotating the ring 40 and thus the barrel 20 relative to the head 11. The barrel 20 includes a bore 22 formed therein and having a circular cross section (FIG. 7) or having a hexagonal cross section (FIGS. 1–6). The barrel 20 includes a number of channels 23, such as three (FIG. 6) or more channels 23, formed in the peripheral portion thereof and communicating with the bore 22 of the barrel 20 for slidably receiving three (FIG. 6) or more drive inserts 30 therein respectively.

Figure 4:
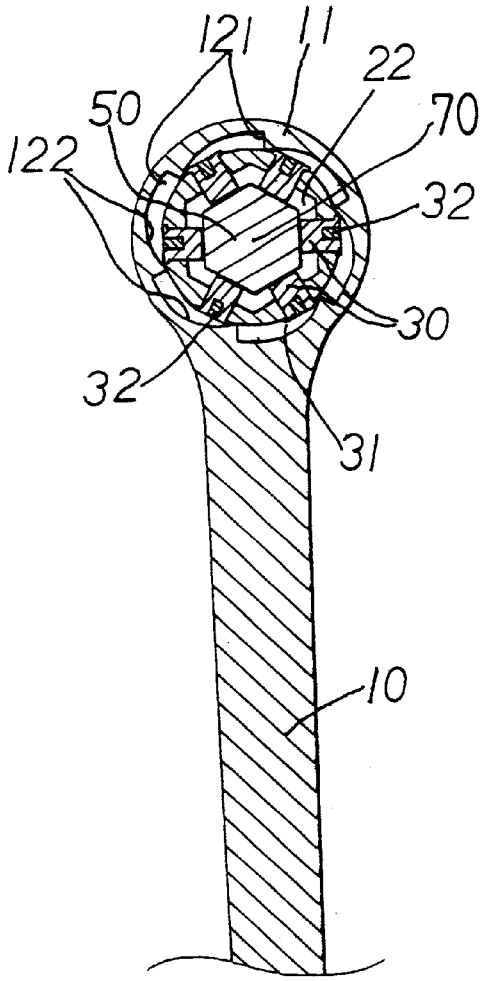
FIG. 4 is a partial cross sectional view similar to FIG. 3, illustrating the operation of the wrench.
Figure 6:
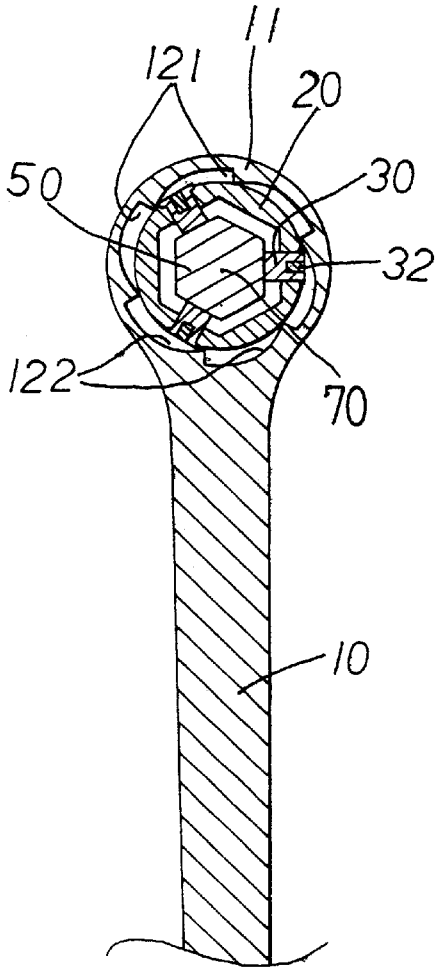
FIG. 6 is a partial cross sectional view similar to FIGS. 3 and 4, illustrating the further application of the wrench.
Figure 7:
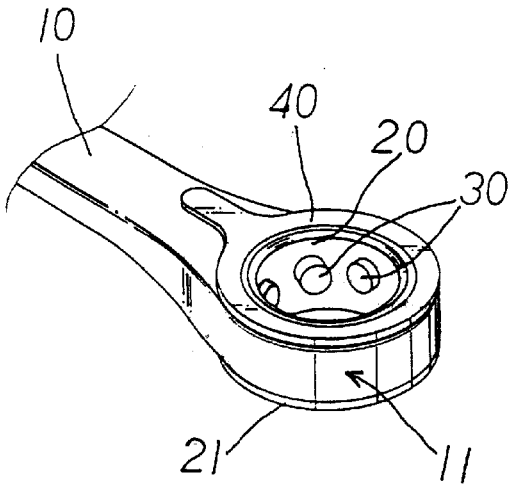
FIG. 7 is a partial perspective view illustrating the still further application of the wrench.

The drive inserts 30 each includes an inner end slidable inwardly of the bore 22 of the barrel 20 for engaging with the fastener 50 to be driven by the wrench (FIGS. 3, 4, 6), and each includes an outer end having a peripheral flange 31 extended radially outward therefrom for engaging with the barrel 20 and for limiting the drive inserts 30 to move relative to the barrel 20 and for preventing the drive inserts 30 from moving into the bore 22 of the barrel 20. The outer ends of the drive inserts 30 may be engaged with the inclined surfaces 122 of the head 11 for determining the inwardly extending of the drive inserts 30 into the bore 22 of the barrel 20. As best shown in FIGS. 3, 4, and 6, the curved and inclined or helical surfaces 122 each has a first end located closer to the center 70 of the opening 12 and/or of the fastener 50 and each has a second end distal to the center 70 of the opening 12 and/or of the fastener 50.

Figure 5:
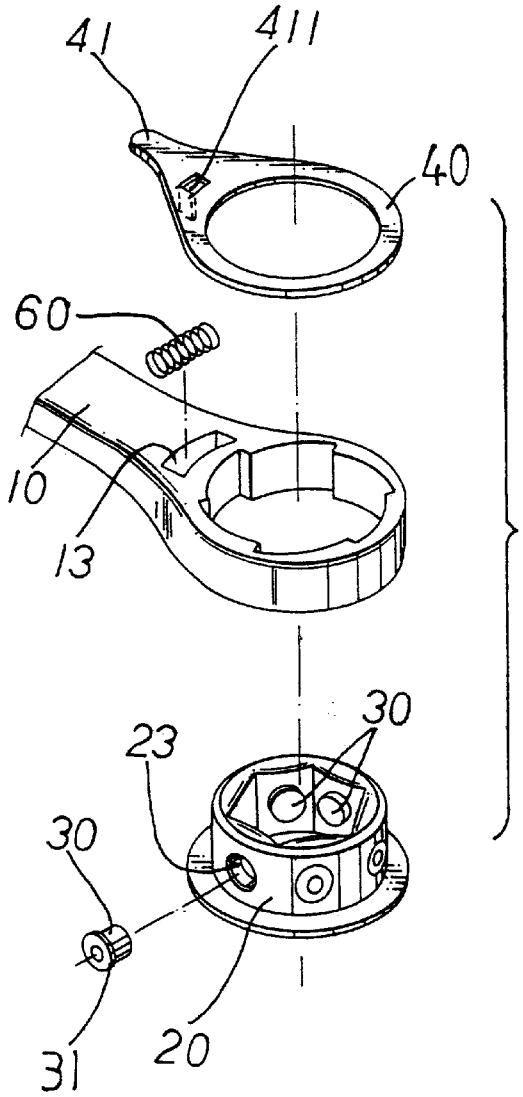
FIG. 5 is a partial exploded view illustrating the other application of the wrench.

As shown in FIG. 5. the head 11 includes a groove 13 formed therein for receiving a spring 60 therein. The ring 40 includes an ear 411 extended therefrom and engaged into the groove 13 of the head 11 and engaged with the spring 60. The spring 60 may bias the barrel 20 to move in direction relative to the head 11 and may bias the outer ends of the drive inserts 30 to engage with either of the ends of the respective inclined surfaces 122 of the head 11, such that the drive inserts 30 may either be forced to engage into the bore 22 of the barrel 20 or be forced outward of the bore 22 of the barrel 20, depending on the biasing force and the biasing direction of the spring 60 onto the ring 40 and the barrel 20. For example, when the outer ends of the drive inserts 30 are forced, by the spring 60, to engage with the first ends of the inclined surfaces 122 that are located closer to the center 70 of the head 11 and/or of the fastener 50 (FIGS. 4, 6), the ring 40 and thus the barrel 20 may be rotated against the spring 60 for moving the drive inserts 30 to the second ends of the inclined surfaces 122 of the head 11 and for allowing the drive inserts 30 to be moved away from the center 70 of the head 11 and/or of the fastener 50 and for allowing the fastener 50 to be engaged into the barrel 20. The drive inserts 30 may be forced, by the spring 60 when the ring 40 is released, to engage with the first ends of the inclined surfaces 122 of the head 11 and may thus be forced inward of the bore 22 of the barrel 20 to engage with the fastener 50 to be driven by the wrench. The spring 60 may also be used to move the drive inserts 30 away from the fastener 50. At this situation, the barrel 20 may be rotated against the spring 60 to move the drive inserts 30 to engage with the fastener 50, by the sliding engagement of the drive inserts 30 with the inclined surfaces 122 of the head 11. When the drive inserts 30 are engaged with the fastener 50, the ring 40 may be released when or after the fastener 50 is driven by the head 11 via the barrel 20 and the drive inserts 30.

The drive inserts 30 may each includes a magnet 32 engaged in a cavity 34 thereof. The magnets 32 may force the drive inserts 30 to engage with or to be disengaged from the fastener 50. However, the magnets 32 are preferably arranged to attracted or to force the drive inserts 30 to move radially outward or to be disengaged from the bore 22 of the barrel 20 for allowing the fastener 50 to be easily engaged into the bore 22 of the barrel 20. The barrel 20 may then be rotated against the magnetic biasing force of the magnets 32 to move the drive inserts 30 to engage with the fastener 50. When the drive inserts 30 are engaged with the fastener 50, the ring 40 may be released and the fastener 50 may be driven by the head 11 via the barrel 20 and the drive inserts 30.

It is to be noted that the drive inserts 30 may be moved inward or outward of the bore 22 of the barrel 20 for allowing the fasteners of different sizes to be engaged into the bore 22 of the barrel 20 before the drive inserts 30 are forced to engage with the fastener 50. The drive inserts 30 may be forced to engage with the fastener 50 either by the spring 60 or by the magnets 32. When the drive inserts 30 are forced to engage with one ends of the inclined surfaces 122 and are forced inward of the bore 22 of the barrel 20 to engage with the fastener 50, the fastener 50 may be driven by the wrench with the head 11 via the barrel 20. When the head 11 is rotated in the reverse direction relative to the barrel 20, the barrel 20 may be rotated in the reverse direction against the spring biasing force or against the magnetic force, and the drive inserts 30 may be moved toward the other ends of the inclined surfaces 122 and may be forced to move outward of the bore 22 of the barrel 20 and may be disengaged from the fastener 50, such that the fastener 50 may be rotated freely in the reverse direction and will not be driven by the head of the wrench. The fastener may thus be driven by the head in one direction via the barrel and the drive inserts, but may be rotated freely relative to the barrel in the reverse direction when the drive inserts are disengaged or moved outward of the bore of the barrel, such that the wrench may be formed as a ratchet wrench.

Accordingly, the wrench in accordance with the present invention includes a simplified adjustable mechanism for engaging with and for driving the fasteners of different sizes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrench comprising:

a drive head including an opening formed therein for defining an inner peripheral portion therein, said opening of said head including a center, said head including a plurality of notches formed in said inner peripheral portion thereof and each defined by an inclined surface, said inclined surfaces each including a first end located closer to said center of said opening of said head and each including a second end located distal to said center of said opening of said head, a barrel rotatably received in said opening of said head, said barrel including a bore formed therein for receiving a fastener to be driven by said drive head and including a plurality of channels formed therein and communicating with said bore of said barrel, said barrel including a first end and a second end, a plurality of drive inserts slidably received in said channels of said barrel respectively, said drive inserts each including a first end extendible inward of said bore of said barrel for engaging with the fastener, said drive inserts each including a second end slidably engaged with said inclined surfaces of said head respectively for determining an engagement of said first ends of said drive inserts into said bore of said barrel, and securing means for rotatably securing said barrel to said head, said securing means including a peripheral stop extended radially outward from said first end of said barrel, and including a ring secured to said second end of said barrel, for engaging with said head and for retaining said barrel within said opening of said head, said ring including a hand grip extended outward therefrom for rotating said ring and said barrel relative to said head.

2. The wrench according to claim 1 further comprising biasing means for biasing said drive inserts to engage with said second ends of said inclined surfaces of said head.

3. The wrench according to claim 1 further comprising biasing means for biasing said drive inserts to engage with said first ends of said inclined surfaces of said head.

4. A wrench comprising:

a drive head including an opening formed therein for defining an inner peripheral portion therein, said opening of said head including a center, said head including a plurality of notches formed in said inner peripheral portion thereof and each defined by an inclined surface, said inclined surfaces each including a first end located closer to said center of said opening of said head and each including a second end located distal to said center of said opening of said head, a barrel rotatably received in said opening of said head, said barrel including a bore formed therein for receiving a fastener to be driven by said drive head and including a plurality of channels formed therein and communicating with said bore of said barrel, a plurality of drive inserts slidably received in said channels of said barrel respectively, said drive inserts each including a first end extendible inward of said bore of said barrel for engaging with the fastener, said drive inserts each including a second end slidably engaged with said inclined surfaces of said head respectively for determining an engagement of said first ends of said drive inserts into said bore of said barrel, and biasing means for biasing said drive inserts to engage with said first ends of said inclined surfaces of said head, said biasing means including a ring secured to said barrel, and a spring engaged between said head and said ring for biasing said ring and said barrel to force said drive inserts to engage with said first ends of said inclined surfaces of said head.

5. The wrench according to claim 4, wherein said head includes a groove formed therein for receiving said spring, said ring includes an ear extended therefrom and engaged into said groove of said head and engaged with said spring.

6. A wrench comprising:

a drive head including an opening formed therein for defining an inner peripheral portion therein, said opening of said head including a center, said head including a plurality of notches formed in said inner peripheral portion thereof and each defined by an inclined surface, said inclined surfaces each including a first end located closer to said center of said opening of said head and each including a second end located distal to said center of said opening of said head, a barrel rotatably received in said opening of said head, said barrel including a bore formed therein for receiving a fastener to be driven by said drive head and including a plurality of channels formed therein and communicating with said bore of said barrel, a plurality of drive inserts slidably received in said channels of said barrel respectively, said drive inserts each including a first end extendible inward of said bore of said barrel for engaging with the fastener, said drive inserts each including a second end slidably engaged with said inclined surfaces of said head respectively for determining an engagement of said first ends of said drive inserts into said bore of said barrel, and a plurality of magnets engaged in said drive inserts respectively for forcing said drive inserts to engage with said first ends of said inclined surfaces of said head.

7. A wrench comprising:

a drive head including an opening formed therein for defining an inner peripheral portion therein, said opening of said head including a center, said head including a plurality of notches formed in said inner peripheral portion thereof and each defined by an inclined surface, said inclined surfaces each including a first end located closer to said center of said opening of said head and each including a second end located distal to said center of said opening of said head, a barrel rotatably received in said opening of said head, said barrel including a bore formed therein for receiving a fastener to be driven by said drive head and including a plurality of channels formed therein and communicating with said bore of said barrel, a plurality of drive inserts slidably received in said channels of said barrel respectively, said drive inserts each including a first end extendible inward of said bore of said barrel for engaging with the fastener, said drive inserts each including a second end slidably engaged with said inclined surfaces of said head respectively for determining an engagement of said first ends of said drive inserts into said bore of said barrel, and a plurality of magnets engaged in said drive inserts respectively for forcing said drive inserts to engage with said second ends of said inclined surfaces of said head.

* * * * *